US006751280B2

(12) United States Patent
Mirzadeh et al.

(10) Patent No.: US 6,751,280 B2
(45) Date of Patent: Jun. 15, 2004

(54) METHOD OF PREPARING HIGH SPECIFIC ACTIVITY PLATINUM-195M

(75) Inventors: Saed Mirzadeh, Knoxville, TN (US); Miting Du, Knoxville, TN (US); Arnold L. Beets, Clinton, TN (US); Furn F. Knapp, Jr., Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 86 days.

(21) Appl. No.: 10/217,088

(22) Filed: Aug. 12, 2002

(65) Prior Publication Data

US 2004/0032923 A1 Feb. 19, 2004

(51) Int. Cl.[7] ..... G21G 1/06

(52) U.S. Cl. ..... 376/189; 376/158; 252/625; 424/1.11; 424/649

(58) Field of Search ..... 376/158, 189; 252/625; 424/1.11, 649

(56) References Cited

U.S. PATENT DOCUMENTS 4,414,145 A * 11/1983 Panek ..... 252/645
5,862,193 A * 1/1999 Jia et al. ..... 376/158
6,074,626 A * 6/2000 Order ..... 424/1.61
2003/0082102 A1 * 5/2003 Court ..... 424/1.11

FOREIGN PATENT DOCUMENTS

WO WO 01/70755 9/2001

OTHER PUBLICATIONS

S. Mirzadeh et al, "Evaluation of Neutron Inelastic Scattering for Radioisotope Production," Appl. Radiat. Isot., 1997 Elsevier Science Ltd. (Great Britain), vol. 48 (No. 4), p. 441–446.

* cited by examiner

*Primary Examiner*—Jack Keith
(74) *Attorney, Agent, or Firm*—Joseph A. Marasco

(57) ABSTRACT

A method of preparing high-specific-activity $^{195m}$Pt includes the steps of: exposing $^{193}$Ir to a flux of neutrons sufficient to convert a portion of the $^{193}$Ir to $^{195m}$Pt to form an irradiated material; dissolving the irradiated material to form an intermediate solution comprising Ir and Pt; and separating the Pt from the Ir by cation exchange chromatography to produce $^{195m}$Pt.

9 Claims, 6 Drawing Sheets

METHOD OF PREPARING HIGH SPECIFIC ACTIVITY PLATINUM-195M

The United States Government has rights in this invention pursuant to contract no. DE-AC05-00OR22725 between the United States Department of Energy and UT-Battelle, LLC.

FIELD OF THE INVENTION

The present invention relates to methods of preparing medically useful radioisotopes, particularly high specific activity radioisotopes, and more particularly to methods of preparing high specific activity platinum-195m ($^{195m}$Pt).

BACKGROUND OF THE INVENTION

There is broad interest, from dosimetric perspectives, on the use of Auger-emitting radioisotopes coupled to specific cellular/nuclear targeting vectors for cancer therapy. The highest radiobiological effectiveness (RBI) results when Auger emitters are incorporated into the highly radiosensitive cell nucleus. Tumor cell-targeted agents radiolabeled with $^{195m}$Pt could offer new opportunities for cancer therapy by high linear energy transfer (LET) Auger electrons, but $^{195m}$Pt is not currently available in sufficiently high specific activity.

OBJECTS OF THE INVENTION

Accordingly, objects of the present invention include: provision of high specific activity platinum-195m ($^{195m}$Pt), provision of a high specific activity Auger-emitting radioisotope for coupling to specific cellular/nuclear targeting vectors for cancer therapy. Further and other objects of the present invention will become apparent from the description contained herein.

SUMMARY OF THE INVENTION

In accordance with one aspect of the present invention, the foregoing and other objects are achieved by a method of preparing high-specific-activity $^{195m}$Pt, which includes the steps of: exposing Irridium-193 ($^{193}$Ir) to a flux of neutrons sufficient to convert a portion of the $^{193}$Ir to $^{195m}$Pt to form an irradiated material; dissolving the irradiated material to form an intermediate solution comprising Ir and Pt; and separating the Pt from the Ir by cation exchange chromatography to produce high specific activity $^{195m}$Pt.

In accordance with another aspect of the present invention, a new composition of matter includes $^{195m}$Pt characterized by a specific activity of at least 30 mCi/mg Pt.

Figure 1:
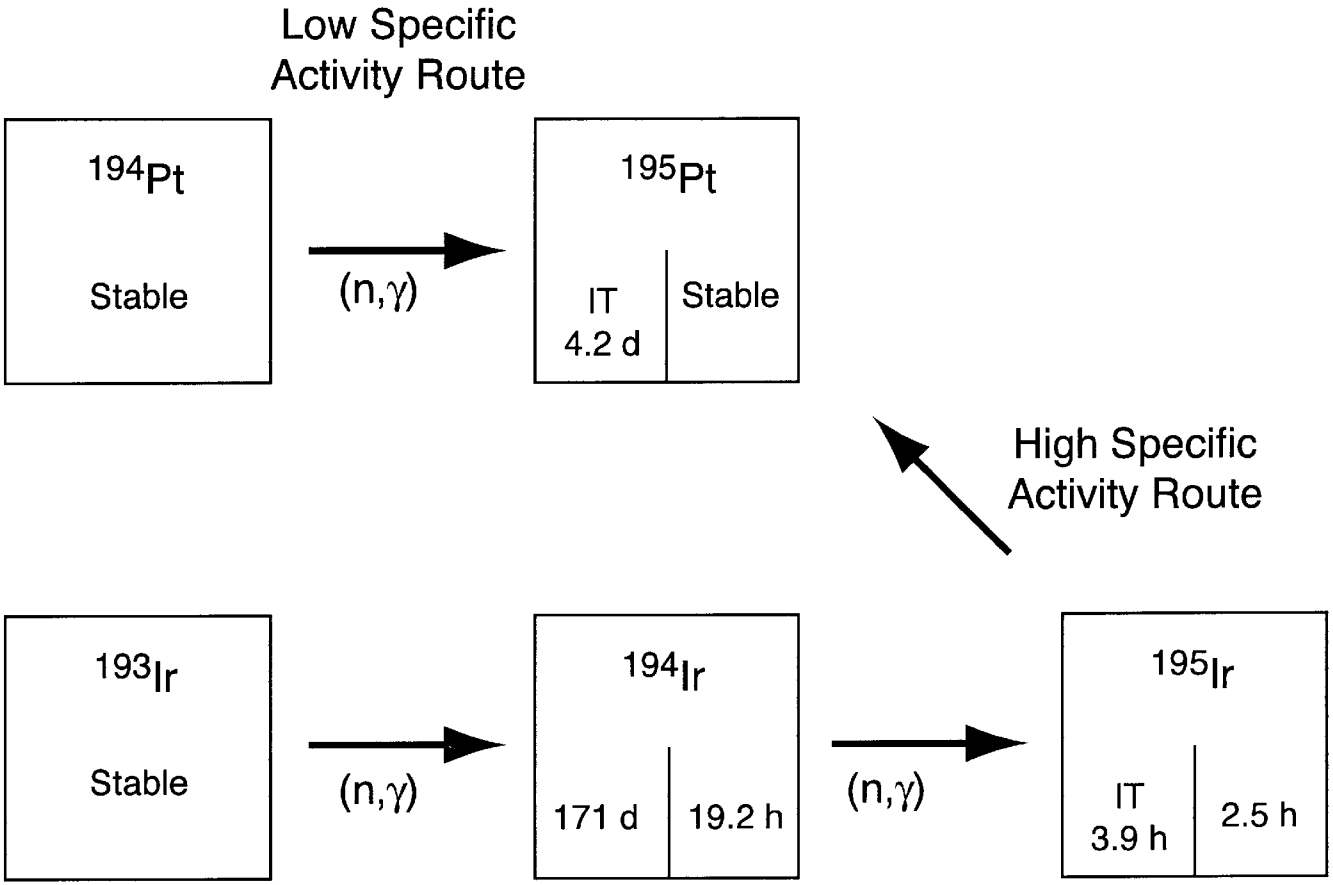
FIG. 1 is a flow chart showing direct and indirect reactor routes for production of $^{195m}$Pt radioisotope, including that of the present invention.

For a better understanding of the present invention, together with other and further objects, advantages and capabilities thereof, reference is made to the following disclosure and appended claims in connection with the above-described drawings.

DETAILED DESCRIPTION OF THE INVENTION

The properties of several key Auger electron emitters are summarized in Table I.

TABLE I

Radionuclides with Potential Application for Intracellular Therapy Which Emit Secondary Electrons

| Radionuclide | Half Life | Primary Emission | Dose from Electrons Δ(i)e - rad.g.$\mu^{-1}$.h$^{-1}$ | Total Dose Δ(i)t - rad.g.$\mu^{-1}$.h$^{-1}$ |
|---|---|---|---|---|
| | | Reactor Produced | | |
| Palladium-103 | 17.0 d | Electron Capture, EC | 0.013 | 0.043 |
| Platinum-195m | 4.02 d | Isomer Transition, IT | 0.390 | 0.552 |
| Platinum-193m | 4.33 d | IT | 0.3 | — |
| Ruthenium-103 | 39.4 d | Beta Decay, β | 0.141 | 1.19 |
| Rhodium-103m | 56.1 m | IT | 0.079 | 0.082 |
| Tin-117m | 14.0 d | IT | 0.343 | 0.678 |
| | | Accelerator Produced | | |
| Bromine-77 | 2.38 d | EC and β | 0.019 | 0.708 |
| Gallium-67 | 3.26 d | EC | 0.073 | 0.403 |
| Germanium-71 | 11.2 d | EC | 0.5 | 0.5 |
| Indium-111 | 2.8 d | EC | 0.074 | 0.936 |
| Indium-115m | 4.5 h | IT and β | 0.364 | 0.708 |
| Iodine-125 | 60.3 d | EC | 0.041 | 0.131 |
| Thallium-201 | 3.06 d | EC | 0.092 | 0.288 |

For $^{195m}$Pt, the principal source of Auger electrons are from the 99.9% conversion of the 135 keV γ-rays, which follow the metastable decay of $^{195m}$Pt, which results in very high radiotoxicity and usefulness for cancer therapy.

Moreover, $^{195m}$Pt is of interest for use a tracer for studies of the biokinetics and mechanism of action of the widely used clinical anti-tumor drug, cis-dicholorodiammineplatinum(II) (also known as Cis-platinum and Cis-DDP), carbo-platinum and other platinum-based anti-tumor agents. The use of $^{195m}$Pt for both biokinetic studies of platinum-based anti-tumor agents and for possible intracellular therapy, however, requires much higher specific activity than is currently available (about 1 mCi/mg). The availability of high specific activity $^{195m}$Pt would thus be expected to be of great interest for the preparation of these agents also.

Neutron inelastic neutron scattering, $^{195}$Pt[n,n']$^{195m}$Pt, was examined as a route to a possible alternative to provide higher specific activity than from the traditional "radiative thermal neutron capture", $^{194}$Pt[n,γ]$^{195m}$Pt, route which provides specific activity values of only about 1 mCi/mg platinum, even at the highest thermal neutron flux available at the core of the Oak Ridge National Laboratory (ORNL) High Flux Isotope Reactor (HFIR) (Oak Ridge Tenn.). In some cases, the yield from the [n,n'] neutron scattering reaction is generally higher than that obtained from the [n,γ] neutron capture reaction. In the case of $^{195m}$Pt, however, the relative gain in the specific activity is only about 1.4, as shown in Table II.

TABLE II

Preparation of $^{195m}$Pt by the Typical Neutron Elastic [n,γ] and Inelastic [n,n'] Reactions in the HFIR Hydraulic Tube Positions (HT)

| Target* | | | Power | | Yield (mCi/mg of Target) | |
|---|---|---|---|---|---|---|
| Isotope | Mass (mg) | Enrichment (at. %) | Level (HT No.) | $T_{irr}$ (h) | Experi-mental | Exp./ Theo. |
| $^{195}$Pt | 6.75 | 95.4 | 9.0 (4) | 1.0 | 0.010 | 1.24 |
| $^{194}$Pt | 4.88 | 97.28 | 9.0 (6) | 1.0 | 0.014 | 0.89 |
| $^{195}$Pt | 8.70 | 97.41 | 85 (6) | 1.0 | 0.083 | 1.15 |
| $^{194}$Pt | 6.20 | 53.40 | 85 (4) | 1.0 | 0.114 | 0.95 |
| $^{195}$Pt | 14.0 | 97.28 | 85 (5) | 138 | 1.40 | 1.4 |
| $^{195}$Pt | 24.0 | 97.28 | 85 (5) | 208 | 1.28 | 1.3 |
| $^{195}$Pt | 24.0 | 97.28 | 85 (7) | 180.8 | 1.55 | 1.2 |

*All targets were metal powder

Figure 2:
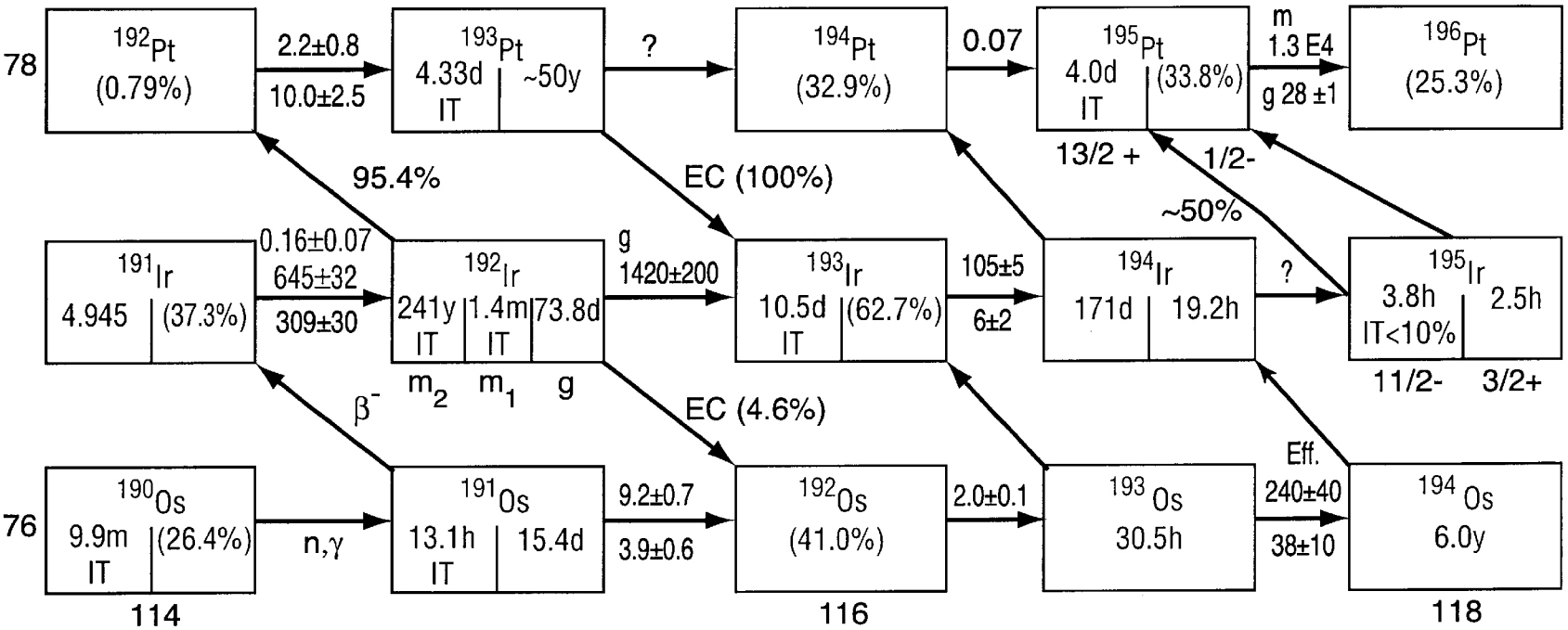
FIG. 2 is a flow chart summarizing various reactor production pathways available for production of $^{195m}$Pt radioisotope, including that of the present invention.
Figure 3:
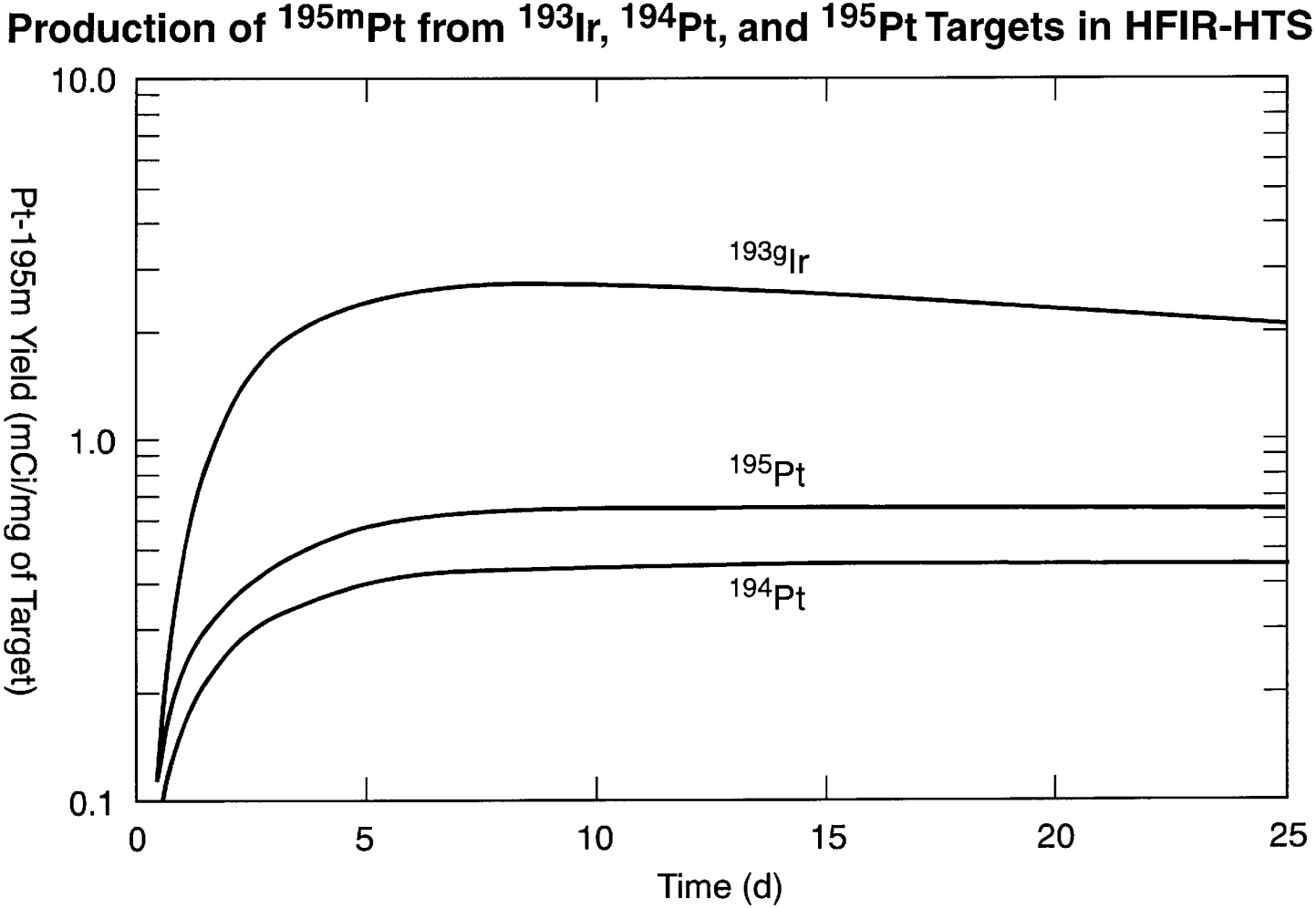
FIG. 3 is a graph comparing the calculated production yields of $^{195m}$Pt produced by three routes, including that of the present invention.
Figure 4:
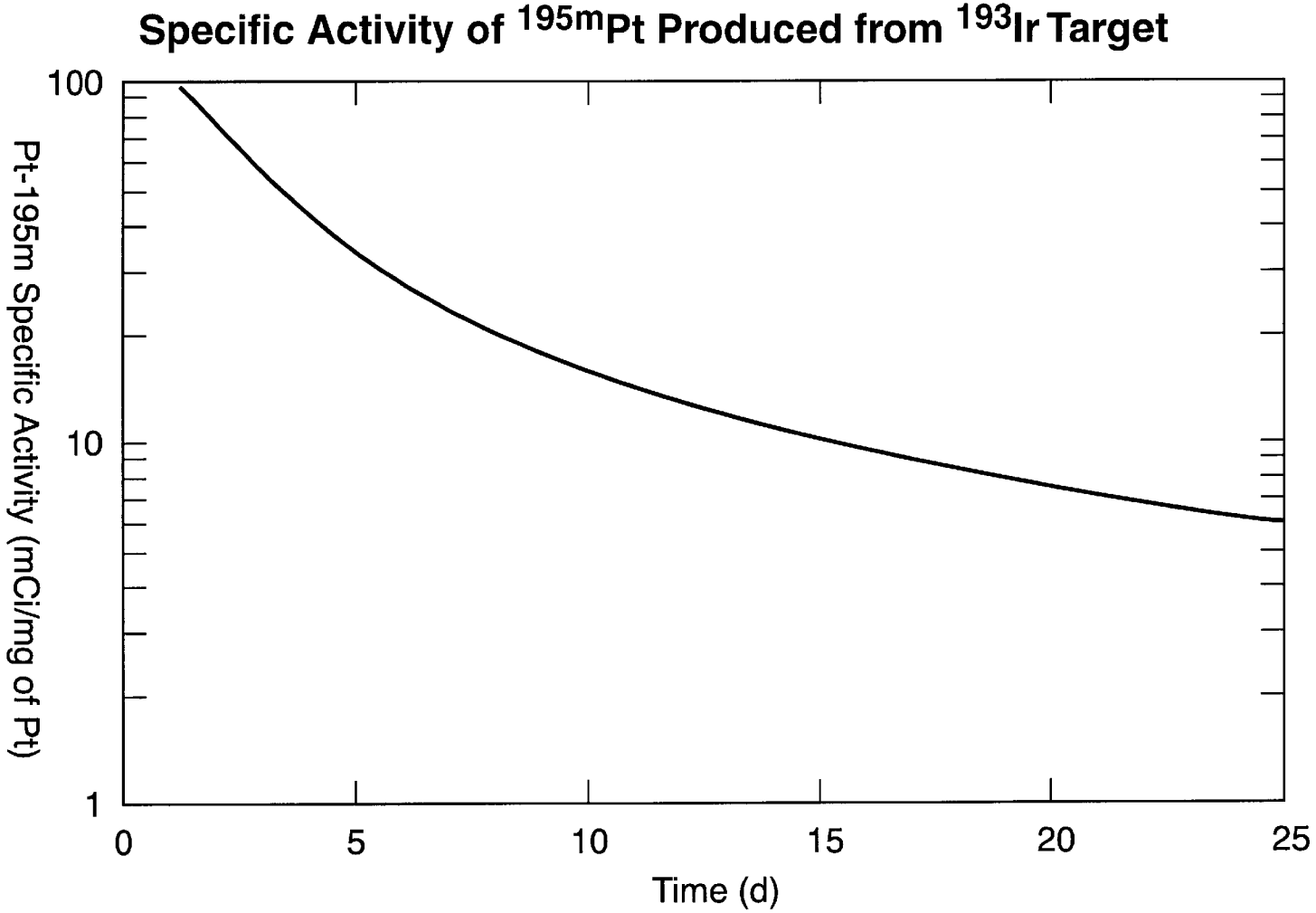
FIG. 4 is a graph showing, over a 25-day period, decrease in specific activity of $^{195m}$Pt produced by irradiation and subsequent decay of $^{193}$Ir target.

In accordance with the present invention, high specific activity, no-carrier-added $^{195m}$Pt can be obtained from reactor-produced $^{195m}$Ir as shown in FIG. 1. FIG. 2 compares the calculated production yields of $^{195m}$Pt produced by $^{194}$Pt and $^{195}$Pt direct routes, and the $^{193m}$Ir indirect route of the present invention.

Irradiation of Enriched $^{193}$Ir Metal Target Material

A high neutron flux reactor such as the ORNL HFIR is required due to the low yield of multi-neutron capture reaction in $^{195m}$Pt production:

$$^{193}Ir[n,\gamma]^{194}Ir[n,\gamma]^{193m}Ir \xrightarrow{\beta(-)} {}^{195m}Pt$$

The $^{193}$Ir target material is preferably in metal powder form, but other physical and/or chemical forms can be used. The level of enrichment of $^{193}$Ir should be at least 80%, preferably at least 90%, more preferably at least 95%, and most preferably at least 98%. The $^{193}$Ir used in testing the present invention was highly enriched 99.59%, which is available from the stable isotope department at ORNL and possibly from similar facilities elsewhere. $^{193}$Ir can be enriched (separated) from natural Ir by several known methods, especially by electromagnetic separation methods.

Irradiation time of $^{193}$Ir in HFIR is operable in the range of several hours to several days, and is generally optimized at 7 to 10 days to produce the greatest $^{195m}$Pt yield.

Hydraulic Tube (HT) position at the HFIR is not particularly critical to the present invention. It is contemplated that HT position No. 5 would be most, preferable due to maximized available neutron flux, although all of nine HT positions, preferably Nos. 4–8 can be used in carrying out the present invention.

As an example, irradiation operations at HFIR or other neutron source may generally include, but are not limited to the following steps:

1. Load desired amount of enriched $^{193}$Ir metal powder into a suitable irradiation vessel, for example, a quartz ampoule.
2. Hermetically seal the vessel under an inert gas blanket, usually He.
3. Load the sealed vessel into a metal (usually aluminum) irradiation vessel, generally known as a "rabbit" and seal by welding, usually by argon arc welding, then perform a standard leak test.
4. Irradiate the rabbit with a high flux of neutrons for a period of time sufficient to convert at least a portion of the $^{193}$Ir to $^{195m}$Pt.

For parameters used in some small batch tests, see Table III.

TABLE III

Preparation of High Specific Activity No-Carrier-Added $^{195m}$Pt by the Present Invention in the HFIR Hydraulic Tube Positions (HT)

| Target* | | | Power | | Yield (mCi/mg $^{193}$Ir) | |
|---|---|---|---|---|---|---|
| Isotope | Mass (mg) | Enrichment (at. %) | Level (HT No.) | $T_{irr}$ (h) | Experi-mental | Exp./ Theo. |
| $^{193}$Ir(R6-218) | 5.0 | 99.59 | 85 (8) | 24 | >72 | 1.6 |
| $^{193}$Ir(R6-218) | 4.88 | 99.59 | 85 (8) | 24 | >76 | 1.6 |

*All targets were metal powder

EXAMPLE I 5 mg of enriched $^{193}$Ir metal powder was prepared as described hereinabove and irradiated for 24 hours in the HT 7 position of the HFIR. Subsequent analysis showed that the process provided >273 mCi $^{195m}$Pt/mg $^{193}$Ir target material, with a calculated $^{195m}$Pt specific activity of >72 mCi/mg Pt. The major radioactive by-product from this irradiation was $^{192}$Ir, with a yield of approximately 0.1 mCi/mg $^{193}$Ir target material.

Dissolution of Irradiated Ir Target Material

Following irradiation, it is necessary to dissolve the Ir target material in order to accommodate hot-cell processing and chemical separation of the $^{195m}$Pt product from the Ir. Hot-cell processing is required because of the high radiation levels of the radioisotopes produced, especially $^{192}$Ir, a radioisotopic by-product.

Iridium metal is very difficult to dissolve, especially with the constraints of hot-cell processing. In addition to the necessity of working in a hot-cell for large-scale preparation, other challenges for chemical separation of the $^{195m}$Pt product from the irradiated $^{193}$Ir target include the relatively short half-life (4.02 days) of the $^{195m}$Pt product and the necessity of separating very low (microscopic) levels of $^{195m}$Pt from the large macroscopic levels of the $^{193}$Ir target material. Therefore, dissolution of the metallic iridium target material is an important step in obtaining the desired $^{195m}$Pt product.

It is desirable to produce a dissolution yield of at least 99%, which has heretofore proven elusive. A method of dissolving the iridium target material has been developed in accordance with the present invention. Iridium metal is dissolved with aqua regia or another strong acid or acidic mixture inside a closed, inert, high-pressure vessel (for example, a polytetrafluoroethylene-lined pressure bomb or a sealed high-temperature-glass ampule) at elevated temperature and pressure.

Aqua regia is generally known as a mixture of conc. HCl and $HNO_3$ in variable proportions. In carrying out the present invention, the ratio of HCl to $HNO_3$ can affect the solubility of the irradiated target material. A ratio of 10:1 HCl:$HNO_3$ was used in experiments with an observed Ir solubility of about 2 mg/ml. It is contemplated that, since the resultant compounds are believed to be chlorides, HCl would preferably be the major constituent. It is further contemplated that the HCl:$HNO_3$ ratio is not a critical parameter to the present invention, but may adjusted to obtain maximum solubility of the target material.

Dissolution can occur at temperature in the range of about 210° C. to about 250° C., preferably in the range of about 215° C. to about 235° C., and most preferably in the range of about 215° C. to about 235° C. Selection of temperature ranges is based on observations wherein 217° C. is the lowest temperature at which Ir metal powder was observed to significantly dissolve and 230° C. is about the melting point of the polytetrafluoroethylene liner. Effective temperature may vary with conditions and equipment used.

Acidic vapors are believed to attain a high pressure inside the pressure bomb or ampule, but the pressure was not measurable during tests of the present invention. The dissolution time under above-described conditions is generally two hours, but dissolution time is not a critical process parameter.

As an example, dissolution operations may generally include, but are not limited to:

1. Open the rabbit in a hot-cell, usually by cutting, and remove the hermetically sealed vessel therefrom.
2. Wash the hermetically sealed vessel with conc. HCl (30%), followed by $H_2O$, and finally alcohol in order to decontaminate the exterior thereof.
3. Break the hermetically sealed vessel by conventional means and empty irradiated target material into a high-pressure reaction vessel having an inert inner surface, for example, a polytetrafluoroethylene-lined pressure bomb.
4. Add sufficient aqua regia into the pressure bomb and close the bomb.
5. Heat the bomb to a sufficient temperature and for a sufficient time to dissolve the irradiated target material.

Steps 4 and 5 are critical to the dissolution aspect of the present invention. It is believed that the dissolved Iridium is in the form of $H_2IrCl_6$ and that the product is in the form of $H_2PtCl_6$, but that issue is not believed to be critical.

EXAMPLE II

Material irradiated in accordance with Example I was dissolved as follows. The rabbit was cut open in a hot cell and the quartz ampoule was emptied into a beaker. The quartz ampoule was washed with HCl, $H_2O$, and then alcohol. The ampoule was crushed in a break tube and the contents thereof were emptied into a polytetrafluoroethylene-lined pressure bomb having a capacity of 22 ml. 15 ml of 10:1 aqua regia ($HCl:HNO_3$) was added into the pressure bomb and the bomb was assembled. The assembled bomb was heated in an oven at 220° C. for two hours. The material dissolved into the solution with very little residue remaining.

Chemical Separation of $^{195m}$Pt Product from Ir

The effective separation of the microscopic amount of Pt product from the macroscopic amount of Ir is an important aspect of the present invention. Conventional methods for the separation of platinum from iridium, including solvent extraction and chromatographic methods, have not been developed to a feasible level of effectiveness. Therefore, a new cation exchange method has been developed to separate microscopic amounts of Pt product from the macroscopic amount of Ir.

A suitable ion-exchange column is loaded with a cation exchange resin, for example, Dowex-50 or AG-50W×4, in any particle size, but preferably in the range of 50–600 mesh resin and conditioned with a solution comprising 0.1M–3M HCl and 0.05M–1M thiourea. The volume of the column is preferably minimal.

The dissolution product of aqua regia containing Pt and Ir is heated to near dryness, dissolved with minimum amount of the HCl-thiourea solution, and loaded onto the column. The column is first eluted with at least 5 to 10 column volumes of the HCl-thiourea solution to elute the Ir. The column is then eluted with HCl in a concentration from 0.5M to 12 HCl (without thiourea) to elute the Pt.

EXAMPLE III

Pt product was separated from Ir as follows. AG-50W×4 (100–200 mesh) resin was loaded into a column having a volume of 0.2 ml and conditioned with >1 ml of a solution comprising 1M HCl and 0.2M thiourea. An aqua regia solution resulting from the process of Example II was heated to near-dryness, re-dissolved with a minimum of the HCl-thiourea solution—about 0.5 ml, and loaded onto the column. The column was then eluted with 4.8 ml of the HCl-thiourea solution to elute the Ir. The column was then eluted with 3.3 ml 12M HCl (without thiourea) to elute the Pt.

Figure 5:
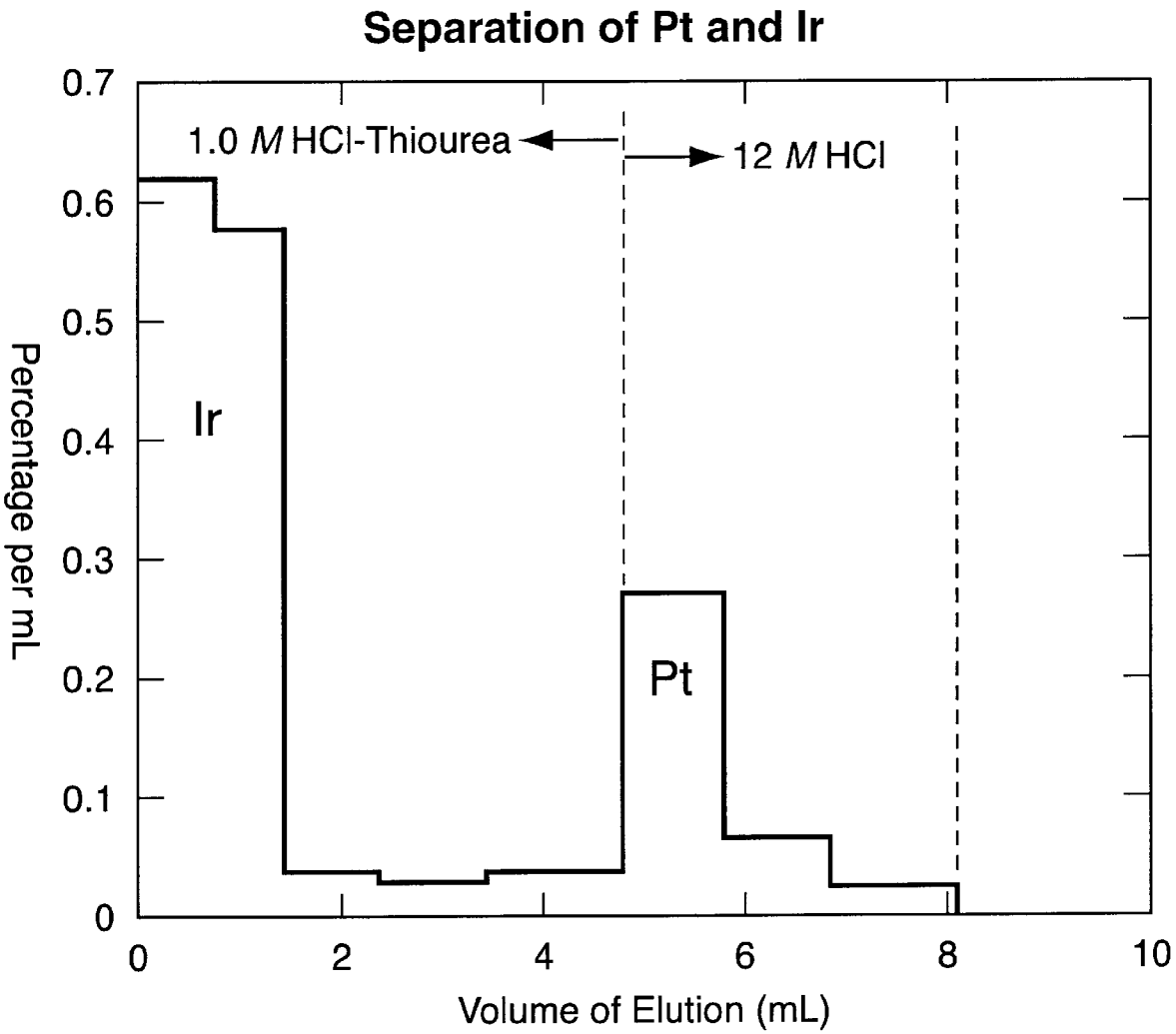
FIGS. 5 and 6 are complementary graphs showing column separation of $^{195m}$Pt from Ir.
Figure 6:
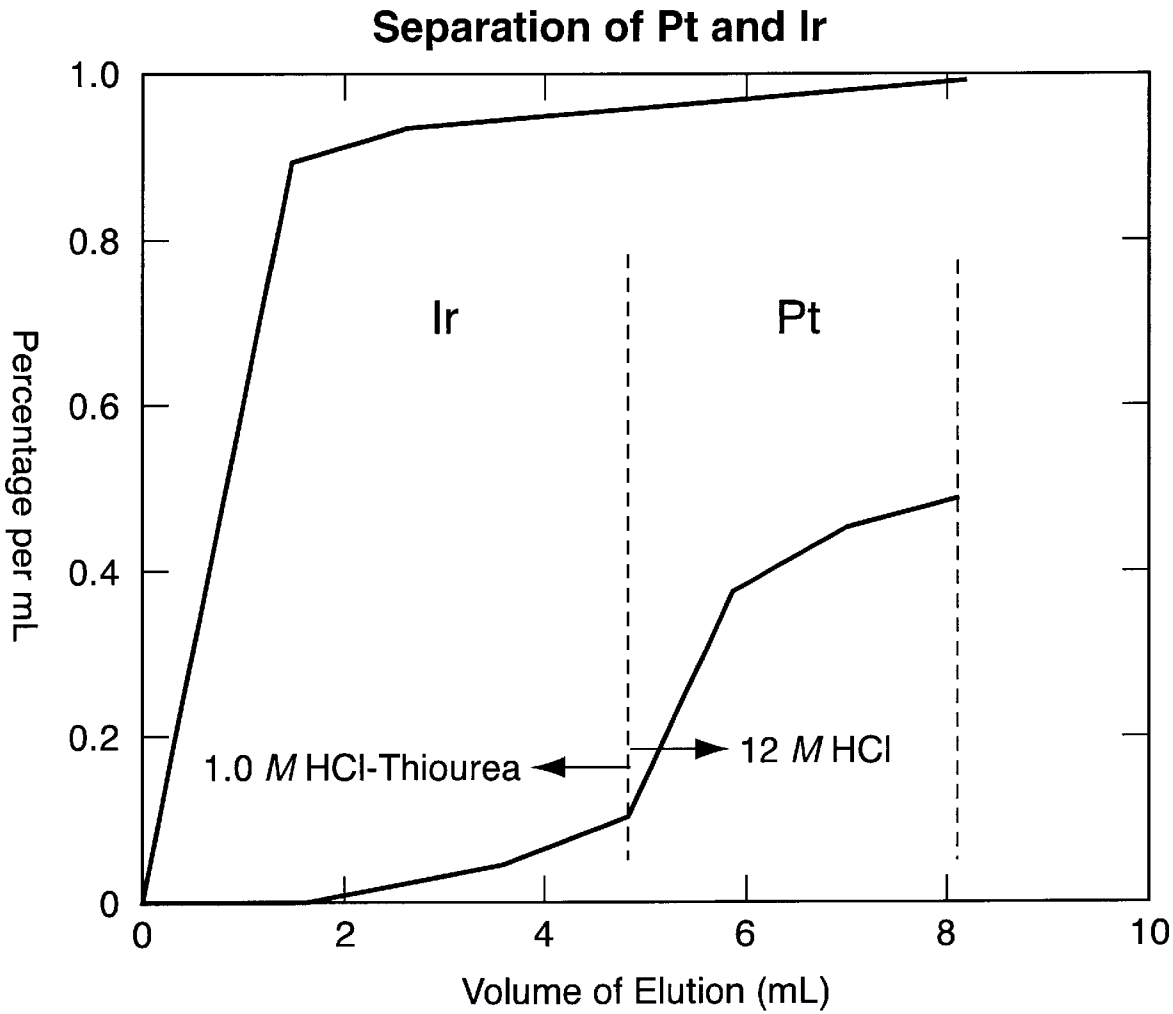

Data from Example III, summarized in FIGS. 5 and 6, demonstrate that 99% of the Iridium was eluted from the column with 4.8 ml of HCl-thiourea solution (about 24 column volumes) with about 20% loss of Pt. It is contemplated that the actual Pt loss under the same conditions may be reduced if a cut is made at <24-column volume elution.

EXAMPLE IV

A larger-scale production of $^{195m}$Pt is carried out as generally described hereinabove and more particularly as follows. 100 mg of highly enriched $^{193}$Ir metal target (>90% enrichment, produced at ORNL) is subjected to 7–10 day neutron-irradiation in the hydraulic tube facility of the ORNL HFIR in accordance with the above description. Following irradiation, the metal powder is dissolved in 100 ml aqua regia in a pressure bomb having an inert liner. The bomb is heated for at least 1 hour at 220° C. in a convection, induction, or microwave oven. After complete dissolution, the dark brown solution containing Ir and Pt is evaporated to near-dryness and the residue is dissolved with in 20 ml of a solution comprising 1M HCl and 0.1 M thiourea. The target solution is loaded on a 4 ml volume cation exchange column (AG 50×4, 200–400 mesh), pre-equilibrated with >8 ml of the HCl-thiourea solution. The Ir is eluted with 20 bed volumes of the HCl-thiourea solution. The $^{195m}$Pt is then eluted with 5 bed volumes of conc. HCl.

The $^{195m}$Pt product eluted from the cation exchange column can be further processed, if desired, to remove more Ir in order to further purify the $^{195m}$Pt.

EXAMPLE V

The $^{195m}$Pt fraction from Example IV is evaporated to dryness and re-dissolved with a minimum volume of the HCl-thiourea solution and loaded onto another cation exchange column and eluted as described hereinabove to effect further separation of Pt from Ir. $HNO_3$ is added to the $^{195m}$Pt fraction, which is then evaporated to dryness and subsequently re-dissolved in 3M HCl.

The $^{195m}$Pt product can be further processed, if desired, to remove a $^{199}$Au byproduct in order to obtain a very high-purity $^{195m}$Pt product.

EXAMPLE VI

The $^{195m}$Pt fraction from Example IV or Example V is further processed to remove a $^{199}$Au by-product therefrom. A 3M HCl solution thereof is extracted in methyl isobutyl ketone (MIBK). The $^{199}$Au by-product is extracted into the MIBK with a little of the Pt, while most of the Pt remains in the aqueous phase. The MIBK is washed with a lower acidity, for example, 1M of HCl to back-extract as much of the Pt as possible from the MIBK. The two aqueous phases are combined and evaporated to dryness and the residue thereof is dissolved in 0.1 M HCl.

Gamma-ray spectroscopy can be used throughout the chemical processing to monitor levels of $^{195m}$Pt, $^{192}$Ir and $^{199}$Au. Mass analysis by mass spectrometry of the final $^{195m}$Pt sample will provide an experimental value for the $^{195m}$Pt specific activity. Specific activity for the $^{195m}$Pt product is at least 30 mCi/mg Pt, preferably at least 50 mCi/mg Pt, more preferably at least 70 mCi/mg Pt, most preferably at least 90 mCi/mg Pt. Maximum attainable specific activity is largely dependent on the available neutron flux.

The skilled artisan will understand that concentrations and amounts of reagents used to elute the Ir and Pt, and to purify the Pt, can vary with conditions and are not critical to the present invention.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A method of preparing high-specific-activity $^{195m}$Pt comprising the steps of:

a. exposing $^{193}$Ir to a flux of neutrons sufficient to convert a portion of said $^{193}$Ir to $^{195m}$Pt to form an irradiated material;

b. dissolving said irradiated material to form an intermediate solution comprising Ir and Pt; and c. separating said Pt from said Ir by cation exchange chromatography to produce a product comprising $^{195m}$Pt.

2. A method in accordance with claim 1 wherein said dissolving step is carried out at a temperature of at least 210° C.

3. A method in accordance with claim 2 wherein said dissolving step is carried out at a temperature of at least 217° C.

4. A method in accordance with claim 1 wherein said intermediate solution further comprises aqua regia.

5. A method in accordance with claim 1 wherein said separating step further comprises the steps of:

a. loading said intermediate solution onto a cation exchange column;

b. eluting said Pt with a first eluent solution comprising HCl and thiourea.

c. eluting said Pt with an essentially thiourea-free second eluent solution comprising HCl.

6. A method in accordance with claim 1 wherein said $^{195m}$Pt product is characterized by a specific activity of at least 30 mCi/mg Pt.

7. A method in accordance with claim 6 wherein said $^{195m}$Pt product is further characterized by a specific activity of at least 50 mCi/mg Pt.

8. A method in accordance with claim 7 wherein said $^{195m}$Pt product is further characterized by a specific activity of at least 70 mCi/mg Pt.

9. A method in accordance with claim 8 wherein said $^{195m}$Pt product is further characterized by a specific activity of at least 90 mCi/mg Pt.

* * * * *